United States Patent [19]

Salzsauler

[11] Patent Number: 4,934,123

[45] Date of Patent: Jun. 19, 1990

[54] CARRIAGE

[76] Inventor: Roy Salzsauler, P.O. Box 271, Georgetown, Canada

[21] Appl. No.: 161,165

[22] Filed: Feb. 25, 1988

[51] Int. Cl.[5] ..... B65B 11/02

[52] U.S. Cl. ..... 53/399; 53/441; 53/556; 53/588

[58] Field of Search ..... 53/556, 587, 588, 399, 53/441

[56] References Cited

U.S. PATENT DOCUMENTS

| | | | |
|---|---|---|---|
| 3,243,845 | 4/1966 | Cassel | 53/556 X |
| 4,109,445 | 8/1978 | Shulman | 53/588 X |
| 4,458,467 | 7/1984 | Shulman | 53/556 X |
| 4,514,955 | 5/1985 | Mouser | 53/556 X |
| 4,722,170 | 2/1988 | Ball | 53/588 X |
| 4,797,252 | 5/1988 | Kape | 53/588 X |

*Primary Examiner*—John Sipos

[57] ABSTRACT

Method and apparatus for dispensing a web of material including; at least one roller adapted to engage said web; structure for rotationally driving said roller when said web is drawn from said roller at a preselected force; planetary gear assembly associated with said driving structure for varying the rate of rotationally driving said roller in response to variation in said force drawing said web from said roller so as to maintain said drawing force at said preselected level.

31 Claims, 321 Drawing Sheets

58
66
68
F 62
60
64
S
94
126
160
42
78
22
70
74
80
82
44
92
54
Q
48
128
96
114
106
56
110
76
113
100
64
50
62
52
154
144
P
118
104
48
140
98
120
112
114
108
116
102
122
46

CARRIAGE

FIELD OF INVENTION

This invention relates to apparatus for wrapping pallet loads with a membrane adapted to contain the load during shipping and transport, and more particularly relates to a method and apparatus for wrapping pallet loads including a planetary gear assembly responsive to variations in the force drawing the membrane from the said apparatus so as to maintain said drawing force at a preselected level.

BACKGROUND TO THE INVENTION

Various methods and apparatus for packaging and shipping goods have heretofore been proposed and implemented. For example, multiple unit products can be stacked in boxes for shipment. Furthermore various boxes or articles may be unitized in a pallet load having a rectangular, square or irregular cross section for shipment by wrapping various boxes or articles with a web of stretched plastic film.

Such arrangements generally include a mechanism which dispenses a web of plastic film as it rotates about the pallet load. Such plastic film may be prestretched between rollers prior to being wrapped around the pallet load.

Generally speaking, the plastic film which is dispensed about said pallet load encounters different load demands or tension as it rotates about the pallet load edges. More particularly, as the plastic film rounds the corner or edge of a pallet load the plastic film must be supplied at a faster speed in order to maintain a constant tension in the plastic film. Various apparatus and method have heretofore been proposed to attempt to maintain a relativiely constant tension in the plastic film.

For example, U.S. Pat. No. 4,676,048 is directed towards apparatus and process for applying stretchable plastic film to loads using a prestretch mechanism which is driven and controlled independently of the web tension to minimize the variation in the force exerted on the film web at load edges by varying the film web supply speed.

Moreover, U.S. Pat. No. 4,628,667 discloses a wrapping machine for wrapping a load in a unitary packaging, said wrapping machine including a mechanism controlling the operation of a variable speed DC driving motor so as to rotate a support at a first speed during a first portion of the rotatable movement of the support and then at a second slower speed during a subsequent portion of the rotatable movement of the support so as to gradually stop the rotation of the support and avoid damage to either the load or stretchable material being used for wrapping the load.

Moreover, U.S. Pat. No. 4,524,568 teaches a rotatable film wrapping apparatus for wrapping a load on a conveyor with an overwrap of stretched plastic film web having a film web prestretching mechanism which is provided with a constant torque by a power assistance mechanism so that the force on the film to the load can be substantially reduced while allowing the prestretch drive to speed up and slow down according to the film demand from corner or changing load.

Furthermore U.S. Pat. No. 4,497,159 discloses apparatus for applying stretchable plastic film to loads using two frictionally connected rollers which are held together and driven by the film web at different speeds to elongate plastic film beyond its yield point.

Also U.S. Pat. No. 4,590,746 discloses a tension maintaining device which applies a biasing force against a tension roller over which stretchable material passes so as to maintain a constant tension on the stretchable material.

Each of the prior art devices generally disclose complicated structure. Moreover, such prior art devices have a relatively slow response time wherein there is a lag betwen the time when a greater supply of plastic web is required and the time that it is actually supplied so that in many cases the plastic film breaks due to the increased tension imparted thereon.

It is an object of this invetion to provide apparatus and a method for dispensing plastic film which is simple to construct and capable of maintaining a preselected tension in the film web as it rotates about the pallet load.

SUMMARY OF THE INVENTION

The broadest aspect of this invetion relates to apparatus for dispensing a web of material including; at least one roller means adapted to engage said web; structure for rotationally driving said roller means when said web is drawn from said roller means at a preselected force; and planetary gear including a rotatable ring gear and output gear, said output gear engageable with said driving structure; a motor for rotating said ring gear and said output gear of said planetary gear; and a brake adapted to variable bear against said ring gear in response to variations in said force drawing said web from said roller means so as to vary the relative rotation of said ring gear and said output gear to vary the rate of rotatably driving said roller means in response to variations in said force drawing said web from said roller means and maintain said drawing force at said preselected level It is another aspect of this invention wherein said roller means comprises a first and second roller adapted to stretch said material a predetermined amount.

It is another aspect of this invention to provide a carriage adapted for rotational movement about a pallet load for dispensing a web of stretchable film about said pallet load comprising; at least one roller means adapted to dispense said web of stretchable film; structure for rotationally driving said roller means when said stretchable film is pulled from said roller means at a preselected tension during rotation of said carriage about said pallet load so as to wrap said stretchable film about said load; and planetary gear means including a rotatable ring gear and a driving sprocket, said driving sprocket engageable with said driving structure; a motor for rotating said ring gear and said driving sprocket of said planetary gear means; a brake adapted to variably bear against said ring gear in response to variations in said tension when said film is pulled from said roller means so as to vary the relative rotation of said ring gear and said driving sprocket to vary the rate of rotatably driving said roller means in response to variations in said tension and maintain said tension of said film at said preselected level.

It is another aspect of this invention wherein said roller means comprises first and second roller means adapted to stretch said stretchable film a predetermined amount during rotation of said carriage about said pallet load so as to wrap said stretchable film around said pallet load.

Yet another aspect of this invention relates to a pallet wrapping machine for wrapping pallet loads with a stretchable plastic film comprising; a support beam adapted for generally horizontal securement to a vertical structure above said pallet load; an arm one end of which is rotatably connected to said beam; carriage means depending from said other end of said arm for dispensing said stretchable plastic film; structure adapted to rotate said arm about said load; said carriage means including, first and second rollers, structure for rotatably driving said first and second rollers so as to stretch said plastic film a predetermined amount between said first and second rollers when said stretched film is drawn from said rollers at a preselected tension as said arm rotates about said pallet load so as to wrap said pallet load with such stretched film, and planetary gear assembly including a rotatable ring gear and an output gear, said output gear engageable with said driving structure; a motor for rotating said ring gear and said output gear of said planetary gear means; and a brake adapted to bear against said ring gear in response to variations in said tension when said film is drawn from said roller means so as to vary the relative rotation of said ring gear and said output gear to vary the rate of rotatably driving said roller in response to variations in said tension and maintain said tension of said film at said preselected level.

A further aspect of this invention relates to a method of wrapping a pallet load with a web of material dispensed from a carriage comprising the steps of: rotating said carriage about said pallet load; dispensing said web of material from at least one roller when said web is pulled from said roller at a preselected tension during rotation of said carriage about said pallet so as to wrap said web about said pallet; and varying the rate of rotatably driving said roller by a planetary gear assembly having a rotatable ring gear and output gear by variably braking said ring gear in response to variations in the tension of said web during rotation of said carriage about said pallet load so as to vary the relative rotation of said ring gear and said output gear to vary the rate of rotatably driving said first and second roller in response to variations in said tension and maintain the tension of said web drawn from said roller at a preselected level.

Another aspect of this invention relates to a method of wrapping a pallet load with a film of stretchable material dispensed from a carriage comprising the steps: rotating said carriage about said pallet load, stretching said stretchable material a preselected amount between a first and second roller when said stretched material is pulled from said rollers at a preselected tension during rotation of said carriage about said pallet so as to wrap said stretched plastic film about said pallet load; and varying the rate of rotatably driving said rollers by planetary gear assembly adding a rotatable ring gear and output gear by variably braking said ring gear in response to variations in the tension of said stretched material during rotation of such carriage about said pallet load so as to vary the relative rotation of said ring gear and said output gear to vary the rate of rotatably driving said first and second roller in response to variations in said tension and maintain said tension of said stretched material drawn from said rollers at said preselected level.

DESCRIPTION OF THE DRAWINGS

These and other objects and features are illustrated and described in the following specification to be read in conjunction with the sheets of drawings in which:

FIG. 5 is an exploded view of the tension control.

DESCRIPTION OF THE INVENTION

In the Figures like numerals represent like elements.

Figure 1:
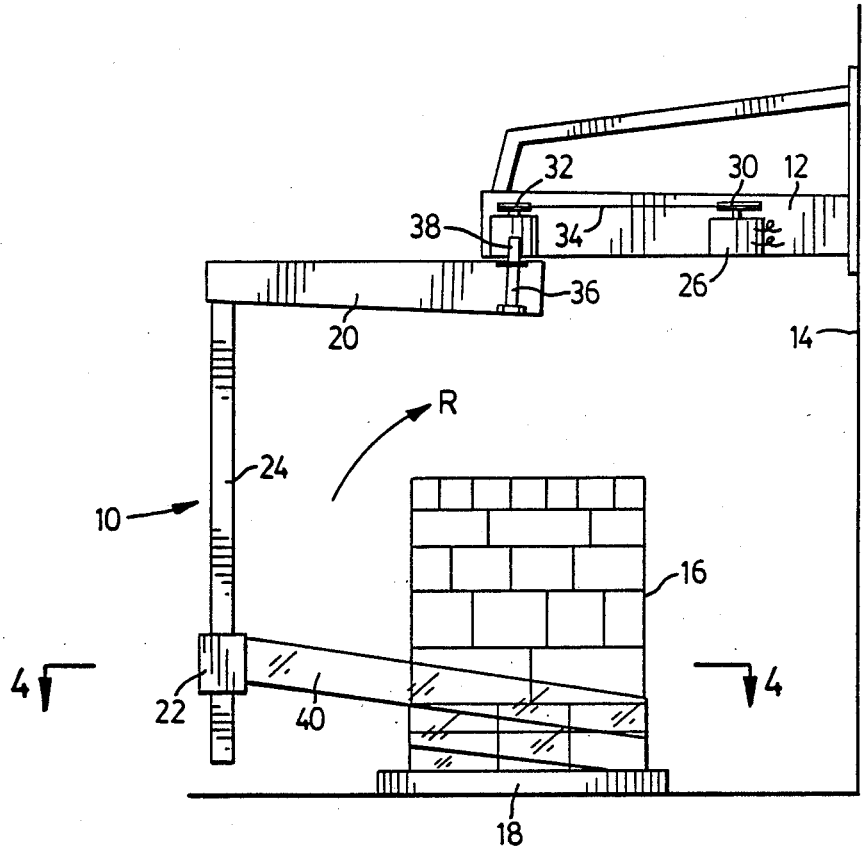
FIG. 1 is a cross sectional view of the pallet wrapping apparatus.

A pallet wrapping machine is generally disclosed as numeral 10 in FIG. 1. The pallet wrapping machine includes a support beam 12 adapted for generally horizontal securement to a vertical structure 14 above a pallet load 16 supported on a pallet 18. An arm 20 is rotatably connected to the beam 12 at one end thereof.

A carriage or dispensing apparatus 22 depends from the other end arm 20. More particularly, the carriage 22 depends along the leg 24 located at the other end of the arm 20.

The support beam 12 houses a motor 26 and a gear box arrangement 28. The motor 26 and gear box 28 each present a pulley and shaft assembly 30 and 32 respectively which are connected together by means of an endless belt 34.

The arm 20 presents a shaft 36. One end of the shaft 36 is fixedly secured to the arm 20 and the other end of the shaft 36 is rotatably connected to the support bar 12. The gear box 28 includes an aperture 38 which fixedly releaseably secures the other end of the shaft 36.

Energization of the motor 26 causes the endless belt 34 to activate gear (not shown) within the gear box 28 thereby rotating a shaft 36 fixedly secured to the arm 20 which causes the arm 20 to rotate about the pallet load 16.

The other end of the arm 20 rotates about pallet load 16 in the direction R, and a web of stretchable material or plastic film 40 is drawn from the carriage 22 in a manner to be more fully particularized herein so as to wrap the pallet load 16 with the web of stretchable material 40.

Furthermore the carriage or dispensing apparatus 22 is adapted to be displaced or moved along leg 24 between upper and lower limits A and B respectively so as to helically wind the stretchable material 40 about pallet load 16 in a manner which is more fully particularized in Canadian Patent Application filed by applicant on Nov. 14th, 1986 as Application No. 523,014-4.

Figure 2:
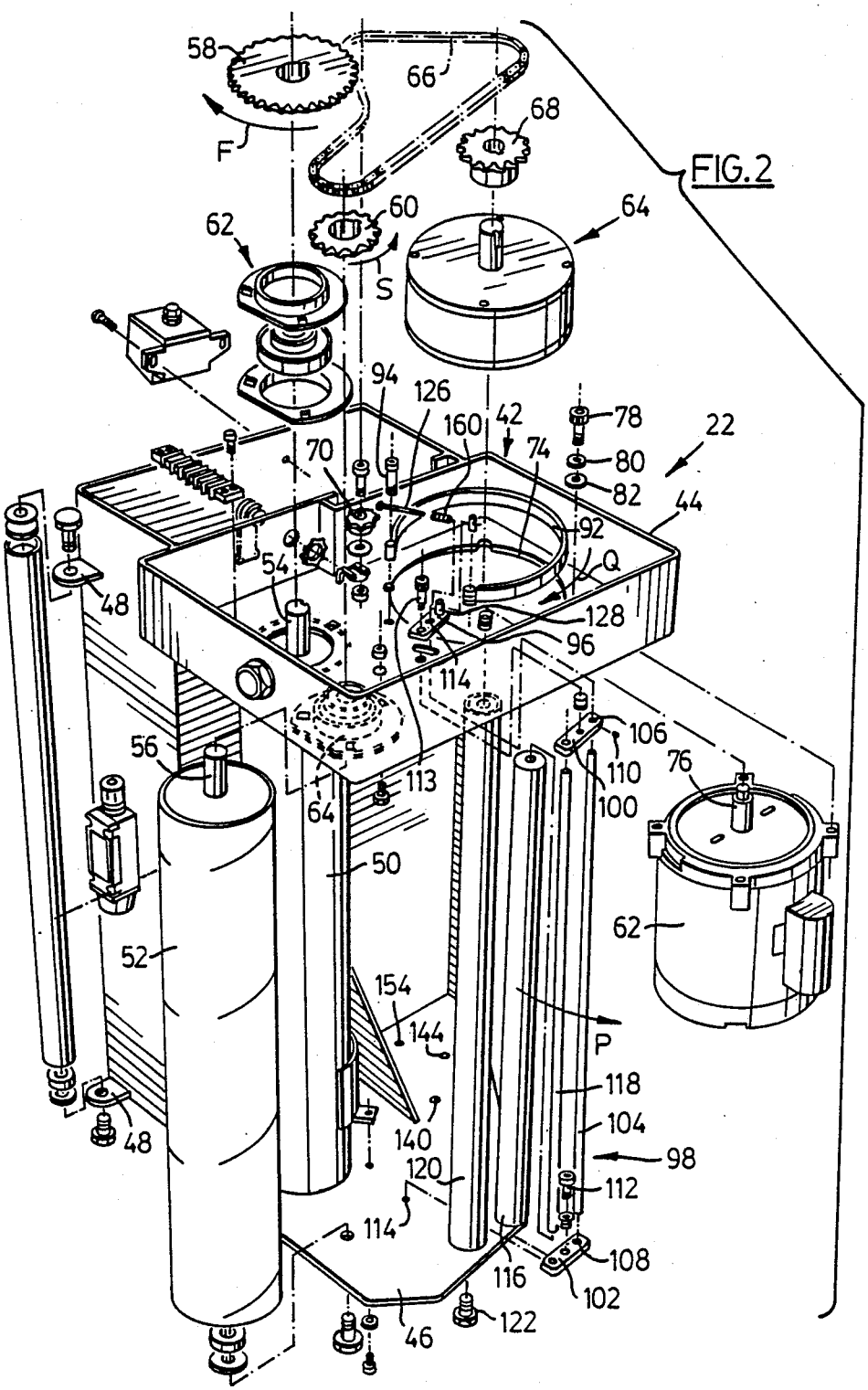
FIG. 2 is an exploded perspective view of the carriage for dispensing the prestretched film.

The apparatus 22 for dispensing a web of plastic film 40 is more fully particularized in FIG. 2.

The apparatus or carriage 22 comprises a carriage housing generally depicted as 42 which includes a top and bottom portion 44 and 46, respectively. The housing 42 includes projections 48 which are adapted to rotatably secure a roll or web of plastic film 40.

Carriage 22 also includes a first roller 50 and a second roller 52 which are adapted to be rotatably secured between top and bottom portions 44 and 46 respectively of carraige 22. The upper ends of first and second rollers 50 and 52 include a shaft 54 and 56 respectively fixedly secured thereto. Shaft 54 and 56 are adapted to engage first and second sprockets 58 and 60.

Electromagnetic clutch means 62 is adapted to be co-axially disposed between first sprocket 58 and first roller 50; and electromagnetic clutch means 64 is adapted to be co-axially disposed between second sprocket 60 and second roller 52. Each electromagnetic clutch means 62 and 64 is electrically connected (not shown) to a power source which is adapted to activate and deactivate the electromagnetic clutch means 62 and 64 so as to engage and disengage the rollers 50 and 52 from the sprockets 58 and 60, respectively.

More particularly when the electromagnetic clutch means 62 and 64 are deactivated, the web of plastic film 40 may be easily pulled or drawn through the first and second rollers 50 and 52 without movement or engagement with the first and second sprocket 58 and 60. In other words the web of plastic material 40 may be easily drawn from the roll of film 40 around the first roller 54 and around the second roller 52 as illustrated in FIG. 2; as the rollers 50 and 54 freely rotate when the electromagnetic clutch means 62 and 64 are in the deactivated stage.

When electromagnetic clutch means 62 and 64 are electrically activated the first and second rollers are engaged with the first and second sprockets 58 and 60 respectively and are adapted to be driven by drive means which include motor 62, planetary gear assembly 64, and endless chain 66.

The endless chain 66 is adapted to be endlessly rotatably driven by drive sprocket 68. As the endless chain 66 is rotatably driven by drive sprockekt 68, the endless chain 66 is rotatably connected to first and second sprocket 58 and 60 and idler sprocket 70 causing the first and second sprockets 58 and 60 to be rotated in the direction of arrows F and S, respectively.

Because second sprocket 60 has a smaller diameter and fewer teeth than first sprocket 58, second sprocket 60 and second roller 52 has a greater revolutions per minute (RPM) than first sprocket 58 and first roller 50.

Furthermore the cylindrical surface of first and second rollers 50 and 52 are adapted to frictionally engage the web plastic film 40. As first roller 50 rotates in the direction of arrow C, the web of film 40 is fed around first roller 50. Since second roller 52 rotates at a higher RPM then the first roller 50, the web of plastic film is stretched between roller 50 and 52.

Figure 4:
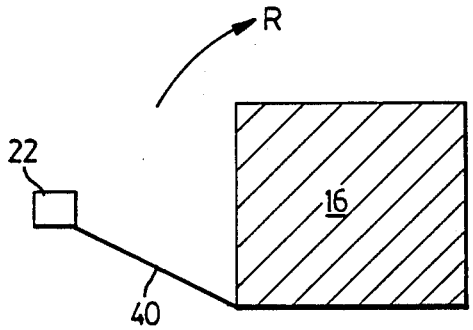
FIG. 4 is a top view of said pallet wrapping apparatus.

As the stretched web 40 is dispensed from first and second rollers 50 and 52 the carriage 22 is rotated around pallet load 16 in the direction of arrow R as best seen in FIG. 4 to wrap the pallet load 16.

When the stretched web 40 rounds corner 72 of pallet 16 there is a tension build-up in the stretched web since the arm 20 generally rotates about pallet load 16 at a constant RPM.

In order to maintain a relatively constant tension in the stretched web 40 rotation of first and second rollers 50 and 52 must be either increased or decreased so that the supply of stretched film 40 is increased or decreased as required.

A planetary gear assembly 64 is utilized herein in order to maintain a constant tension in the stretched film 40.

An electric motor 62 is located in the region between the top and bottom portions 44 and 46 respectively of carriage housing 42, and particularly in the region adjacent to top portion 44.

The top portion 44 includes an opening 74 which is adapated to receive the driving shaft 76 of motor 62. The motor 62 is fixedly secured to top portion 44 of carriage 42 by means of fasteners 78, lock washer 80 and washer 82. The motor 62 is adapted to drive roller 50 and 52 in a manner to be more fully particularized herein.

A planetary gear assembly 64 is engageable with driving means, namely endless chain 66 and sprockets 58 and 60, and is engageable with motor 62.

Figure 3:
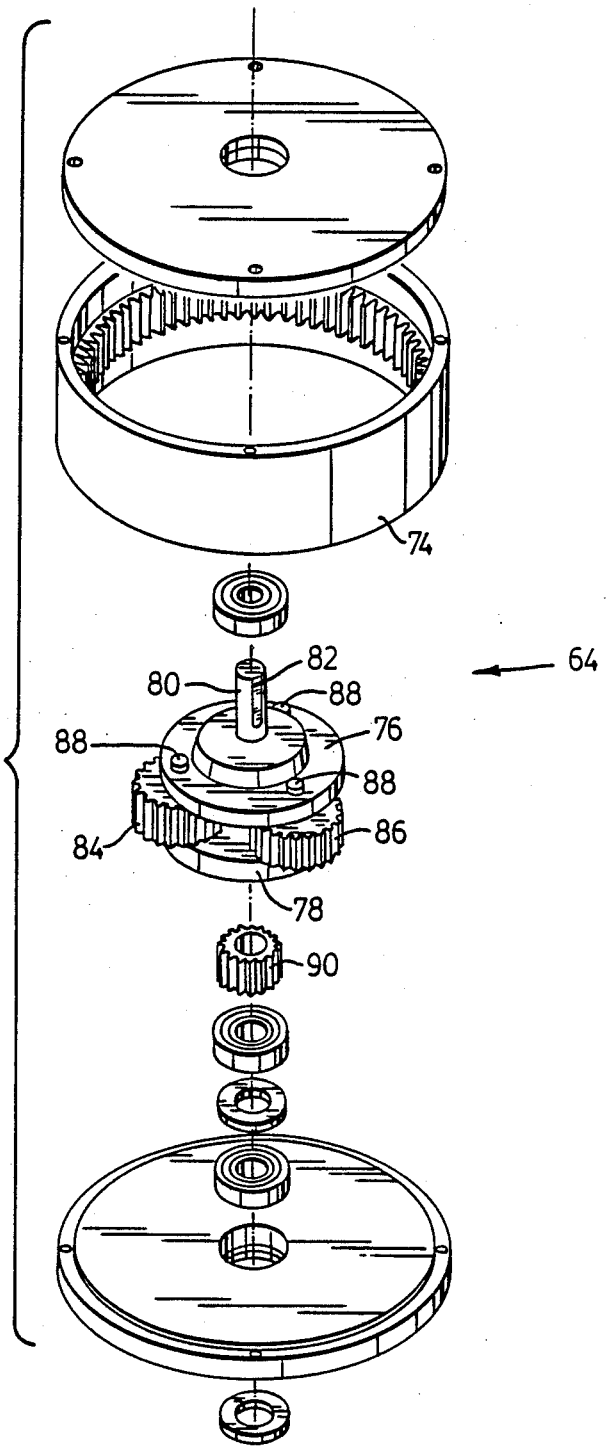
FIG. 3 is an exploded perspective view of the planetary gear assembly.

The planetary gear assembly 64 is more fully particularized in FIG. 3 and includes ring gear 74, spaced first and second discs 76 and 78 which are concentrically disposed interiorally of the ring gear 74. One of the discs, namely disc 76, includes a driving shaft 80 which is fixedly secured to the disc 76. The driving shaft 80 is also removably fixedly secured to driving sprocket 68 or output gear 68 by means of key ways 82 and key 84 (not shown). The other disc 78 includes an aperture (not shown).

A plurality of planetary gears 84, 86 and 87 (not shown) are symetrically disposed between disc 76 and 78 and rotatably engagable with the ring gear 74. The planetary gears 84, 86 and 87 are rotatably secured between disc 76 and 78 by means of bots 88.

A sun gear 90 is rotatably driven by shaft 76 of motor 62. The sun gear 90 is adapted to be received by the aperture (not shown) of disc 78 and is rotatably engagable with the planetary gears 84, 86 and 87 so as to variably rotatably drive the ring gear 74 and the drive sprocket 88 secured to the disc 76 as shall be more fully particularized.

Since motor 62 is adapted to rotate at a relatively constant speed RPM, sun gear 90 also rotates at a relatively constant speed or RPM. Since sun gear 90 is rotatably engaged with planetary gears 84, 86 and 87, such planetary gears will be driven by sun gear 90. The rotational motion of planetary gears 84, 86 and 87 will be transferred either to ring gear 74 or drive gear 68.

Since drive gear 68 is adapted to be engaged with endless chain 66 which in turn is engagable with sprockets 58, 60, 70 and first and second rollers 50 and 52, there will be an inherent resistance or inertia to the rotation of drive gear 68. Accordingly the rotational motion of planetary gears 84, 86 and 87 will be transferred to the path of least resistance namely ring gear 74. When the ring gear 74 is subjected to a resistance or drag force the rotational motion of planetary gears 84, 86 and 87 will be differentially transferred to rotate disc 76 which is fixedly secured to drive gear 68.

The more drag or friction that ring gear 74 is subjected to, the more rotational motion is transferred to drive gear 68. Accordingly the more drag imparted on ring gear 74, the faster the endless chain 66 rotates which in turn rotates first and second rollers 50 and 52 to supply the stretched film 40 at a greater demand rate.

A brake or band 92 is utilized to perform the variable rotational means of the planetary gear assembly 64.

The band 92 is adapted to substantially encircle ring gear 74. One end of band 92 is fixedly secured to the top portion 44 by means of fasteners 94. The other end of the band 92 is displaceably connected to pivot mounting 96 by means of screw 126 and threaded portion 128. The pivot mounting 86 is also connected to a dancer bar assembly 98. The dancer bar assembly 98 comprises top and bottom plates 100 and 102 respectively, and bar 104 which is adapted to be received within aperture 106 and 108 of top and bottom plates 100 and 102 respectively.

The upper portion of bar 104 is adapted to be received by aperture 114 of pivot mounting 96. Set screws 110 fixedly secure the bar 104 to the top and bottom plates 100 and 102.

The bottom plate 102 is pivotly secured about set screw 112 which is fixedly secured to bottom portion 46 of carriage 22 within threaded hole 114. The top plate 100 is pivotly secured to the top portion 44 of carriage 22 by screw 113.

The dancer bar assembly 98 also includes a dancer roller 116 which is adapted to idle or freely rotate about shaft 118 which is fixedly secured to top and bottom plates 100 and 102.

Since the idle roller 120 is provided between top and bottom portions 44 and 46 respectively, the idler roller 120 is secured to be freely rotatable between top and bottom portions 44 and 46 by means of screws 122 and set screw 124.

The web of film 40 is adapted to be inserted between dancer roller 116 and bar 104 and to rotatably engage the cylindrical surface of dancer roller 116 as best illustrated in FIG. 2.

The web 40 is also adapted to rotatably engage the cylindrical surface of idler roller 120. The operation of the dispensing apparatus 22 shall now be described by reference to FIG. 2.

When the stretched material 40 is pulled from the carriage 22 at a preselected tension as shall be more fully particularized herein, the dancer roller 116 is pulled by the web 40 in a direction illustrated by arrow P which causes the pivot mounting and top and bottom plates to pivot about screws 112 and 113 in the direction of arrow Q.

When the pivot mounting 96 pivots about screws 113 in the direction of arrow Q the diameter of brake 92 becomes smaller and adapted to frictionally engage ring gear 74.

Accordingly as the web of plastic material 40 is pulled at a tension greater than a preselected tension sufficient to cause the brake 92 to frictionally engage the ring gear 74 so as to differentially transfer rotational energy or motion to drive gear 68 and thereby drive first and and second roller 50 and 52 so that the web of plastic material will be stretched between the rollers 50 and 52 and dispensed in the stretched mode. The greater the force that stretched film 40 is pulled from the carriage 22, the more rotational energy is transferred to drive sprocket 68, and the faster that endless chain 66 is driven, and the faster that first and second rollers 50 and 52 will be driven so as to stretch the film 40 between the rollers 50 and 52 and thereby dispense stretched film 40 at a faster speed and thereby relieving the tension in the film 40 drawn from the carriage 22.

It should be noted that the amount of stretching of the web of plastic 40 between first and second rollers 50 and 52 is dictated by the difference in the rotation of rollers 50 and 52 which depends upon such factors as the diameter of the rollers and the gear ratios of the sprockets 58 and 60. The amount of stretch is predetermined for any set of diameter of rollers and gear ratios of sprockets 58 and 60 and is not depended on the rate of rotation of the endless chain 66, since rollers 50 and 52 are interconnected and the amount of stretch of the film will be the same whether the rollers 50 and 52 speed up or slow down, and only the speed or supply/demand of the stretched film will vary as required.

Although the preferred web material utilized herein comprises of stretchable plastic film 40 and particularly linear low density polyethylene (LLD) a web of paper or the like could also be used.

Furthermore it has been found that most plastic films when stretched above their yield point gain significantly in ultimate strength. For example, when 50 guage LLD film 40 is stretched 260% the resultant stretched film has a guage of approximate 13.8 guage having increased strength characteristics. Furthermore since the first and second rollers 50 and 52 are located relatively close to one another there is very little necking or shrinkage of the web along the axis of the rollers 50 and 52.

Moreover it has been found that the 50 guage LLD film subjected to a 230% stretching has a 10% memory. In other words when the stretched material 40 is dispensed from the carriage 22, the web 40 will shrink 10% of the stretched length. Such memory assists in the holding of palletized articles wrapped with stretched film as the memory or tendency to shrink will assist in holding the articles together under compression. If the 50 gauge LLD film is stretched 260% the stretched film has a 2% memory. It has been found that LLD film having a stretch of 400% can be consistently produced without tearing under working conditions by utilizing the carriage 22 as described herein. Film which has been stretched up to 400% has substantially no memory.

Furthermore 50 guage of stretched film may be controlled or selected by increasing or decreasing the amount of stretch such as for example selecting the diameter of rollers 50 and 52 or gear ratios of sprockets 589 and 60.

FIG. 5 illustrates the means for selecting the tension at which the stretched web may be wrapped around pallet load 16. Prior to describing such structure it should be noted that the memory of the stretched film 40 will also add a component of tension within the film due to the tendency of the film to shrink.

The structure of FIG. 5 is adapted to select the tension at which the tension of the web will be drawn from the carriage 22.

The tension selecting means 130 includes a ratchet wheel 130, pawl 134 and tension adjusting gear 136. The tension adjusting gear 136 is rotatably secured to the bottom portion 46 by means of screw 138 which is thereby screwed to threaded hole 140 of bottom portion 46.

The ratchet wheel 132 is rotatably secured to the bottom portion 46 by means of screw 142 secured to threaded hole 144 of bottom portion 46.

The ratchet wheel 132 also included a tension spring 146 one end of which is fixedly secured to ratchet wheel 132 and the other end of which is adapted to engage bar 104.

The pawl 134 is biased against ratchet wheel 32 by means of biasing spring 148, one end of which is secured to pawl 132 by means of screw 150 and the other end of which is secured to a threaded hole 154 in bottom portion 46 by means of screw 152.

Pawl 134 is adapted to pivot about screw 156 which is threadedly secured to threaded hole 158 of bottom portion 46.

As the tension gear 136 is rotated in the direction of arrow T the ratchet wheel is rotated in the direction of arrow S as the pawl 134 allows rotation of ratchet wheel 132. By rotating ratchet wheel 132 in the direction of arrow S, the tension in tensioning spring 146 is increased thereby increasing the tension force that must be applied to the bar 104 of dancer assembly 98. This in turn increases the tension force which must be applied to the stretched film 40 in order to pivot or activate pivot mounting 96 and band 92.

It should be noted that a fine tune tensioning means is also provided by means of screw 126, spring 160 and threaded post 128 located at the other end of brake 92. The threaded screw 126 may be turned to increase or decrease the diameter of brake 92.

The operation of the pallet wrapping machine incorporating the invention herein shall now be described. As arm 20 rotates about pallet load 16 the carriage 22 reciprocates along leg 24 between upper and lower limits A and B respectively. A web of plastic material 40 is rotationally wrapped around load 16 as best illustrated in FIG. 1. As the film 40 is wrapped around load 16 the web of material 40 is stretched between rollers 50 and 52 and accordingly the pallet load 16 is wrapped with stretched film. The amount of stretching is selected in a manner as described above. Futhermore the tension at which the stretched web 40 is wrapped around pallet load 16 is selected by means of adjusting the tension selecting means 130 or the fine tune tensioning means as described above. Accordingly when the carriage 22 is rotated about load 16 the planetary gear structure 64 will vary the rate of rotatably driving the rollers 50 and 52 in response to variations of tension of the web 40 pulled from the rollers 50 and 52 during rotation of the carriage 22 about the pallet 16 so as to maintain the tension of the web at the preselected level as more fully particularized above.

Although FIG. 1 illustrates the use of the carriage 22 being rotated about a vertical axis to wrap a pallet 16; the carriage 22 may also be utilized in a wrapping machine 10 when the carriage 22 is adapted to be rotated about a horizontal axis.

The invention described herein is more sensitive and has a faster response time than the time prior art devices used heretofore. More particularly the prior art devices which utilize a motor having a variable RPM to increase the supply of film exhibit a time delay or inertia to build up speed, in order to supply more film as required. Such delay results in increased tension in the film wrapping the pallet and contributes to the tearing of the film. The invention described herein has available kinetic energy which is substantially immediately available to be transferred to the driving mechanism as required to dispense the film. Accordingly the tension of the web 40 is more accurately controlled by the carriage 22 and there is less film tearing as the web of material rounds corners 72 due to the improved tension maintaining characteristics of the carriage 22. With less tearing there is less down time of the machine.

More particularly the tensioning means 130 may be accurately and finally controlled so that it is now possible for empty plastic bottles to be wrapped with stretched film without knocking or dislodging such bottles from the pallet load 18.

It should also be noted that the carriage 22 described herein may be adapted so that only one roller means is provided to dispense a web of material without stretching the web 40 but still providing the substantially simultaneous increase or decrease or the speed of film 40 required in order to maintain the tension of the web of material 40 at the preselected level.

Although the preferred embodiment as well as the operation and use has been specifically described in relation to the drawings, it should be understood that variations in the preferred embodiment could be easily achieved by a skilled man in the trade without departing from the spirit of the invention. Accordingly the invention should not be understood as being limited to the exact form revealed in the drawings.

The embodiments of the invention in which an exclusive property or privilege is claimed are defined as follows:

1. Apparatus for dispensing a web of material including:

(a) at least one roller means adapted to engage said web;

(b) means for rotatably driving said roller means when said web is drawn from said roller means at a preselected force;

(c) planetary gear means including rotatable ring gear means and output means, said output means engageable with said driving means;

(d) means for rotating said ring gear means and said output means of said planetary gear means;

(e) braking means adapted to variably bear against said ring gear means in response to variations in said force drawing said web from said roller means so as to vary the relative rotation of said ring gear means and said output means to vary the rate of rotatably driving said roller means in response to variations in said force drawing said web from said roller means and maintain said drawing force at said preselected level.

2. Apparatus is claimed in claim 1 wherein said web of material comprises a web or stretchable material.

3. Apparatus as claimed in claim 2 wherein said roller means comprises first and second roller means adapted to stretch said material a predetermined amount.

4. Apparatus as claimed in claim 3 including electromagnetic clutch means for engaging said drive means from said roller means.

5. Apparatus as claimed in claim 4 wherein said second roller means is adapted to rotate at a higher rate than said first roller means so as to stretch said material between said first and said second roller means.

6. Apparatus as claimed in claim 5 including variable tensioning means for selecting the level of said drawing force.

7. A carriage adapted for rotational movement about a pallet load for dispensing a web of stretchable film about said pallet load comprising:

(a) at least one roller means adapted to dispense said web of stretchable film;

(b) means for rotatably driving said roller means when said stretchable film is pulled from said roller means at a preselected tension during rotation of said carriage about said pallet load so as to wrap said stretchable film about said load;

(c) planetary gear means including a rotatable ring gear and a driving sprocket, said driving sprocket engageable with said driving means;

(d) means for rotating said ring gear and said driving sprocket of said planetary gear means;

(e) braking means adapted to variably bear against said ring gear in response to variations in said tension when said film is pulled from said roller means so as to vary the relative rotation of said ring gear and said driving sprocket to vary the rate of rotatably driving said roller means in response to variations in said tension and maintain said tension of said film at said preselected level.

8. A carriage as claimed in claim 7 wherein said roller means comprises said first and second roller means adapted to stretch said material a predetermined amount during rotation of said carriage about said pallet so as to wrap said stretch film about said pallet load.

9. A carriage as claimed in claim 8 wherein said second roller means is adapted to rotate at a higher rate than said first roller means so as to stretch said stretchable film a predetermined amount between said first and second roller means.

10. A carriage as claimed in claim 9 wherein said drive means includes an endless chain adapted to rotate said first and second roller means.

11. A carriage as claimed in claim 10 wherein said first and second roller means include first and second sprocket means respectively adapted to engage said endless chain means.

12. A carriage as claimed in claim 11 wherein said means for rotating said ring gear and said driving sprocket comprise a motor.

13. A carriage as claimed in claim 12 wherein said planetary gear means includes:

(a) said ring gear;

(b) spaced first and second disc means concentrically disposed interiorally of said ring gear wherein one of said disc means includes an aperture and said other disc means includes said driving sprocket fixedly secured to said other disc so as to drive said endless chain;

(c) a plurality of planetary gears symmetrically disposed between said disc means and rotatably engageable with said ring gear;

(d) a sun gear rotatably driven by said motor means and adapted to be received by said aperture means of said disc means and rotatably engageable with said planetary gears so as to variably rotatably drive said ring gear and said drive sprocket fixedly secured to said disc in response to variations in said tension of said stretched film.

14. A carriage as claimed in claim 13 wherein said planetary gears rotatably drive only said ring gear when said tension in said stretch material is less than said preselected level.

15. A carriage as claimed in claim 14 including brake means for varying the rotation of said ring gear and said drive sprocket in response to variations in said tensions of said stretched film.

16. A carriage as claimed in claim 15 wherein said brake means is adapted to variably frictionally engage said ring gear means and variable slow rotation of said ring gear when said tension in said stretchable material variably exceeds said preselected level so as to variably increase the rotation of said drive sprocket, said endless claim, and said first and second sprockets, to rotatably increase the rotation of said first and second roller means so as to increase the speed of dispensing said film stretched at said preselected amount and thereby maintain said tension of said stretched film at said preselected level.

17. A carriage as claimed in claim 16 including tension selecting means associated with said brake means and adapted to sense the tension of said prestretched film and variably activate said brake means in response to variations in the tension of said stretched film.

18. A carriage as claimed in claim 17 wherein said first and second roller means include first and second electromagnetic clutch means respectively for engaging and disengaging said roller means from said sprocket means.

19. A carriage as claimed in claim 18 wherein said carriage is adapted to rotate about said pallet load about a vertical axis.

20. A carriage as claimed in claim 18 wherein said carriage is adapated to rotate about said pallet load about a horizontal axis.

21. A pallet wrapping machine for wrapping pallet loads with a stretchable plastic film comprising:

(a) a support beam adapted for generally horizontally securement to a vertical structure above said pallet load;

(b) an arm or an end of which is rotatably connected to said beam;

(c) carriage means depending from said other end of said arm for dispensing said stretched plastic film;

(d) means adapted to rotate said arm about said load;

(e) said carriage means including:

(i) first and second roller means;

(ii) means for rotatably driving said roller means so as to stretch said plastic film a predetermined amount between said first and second roller means when said stretched film is drawn from said roller means at a preselected tension as said carriage rotates about said pallet load so as to wrap said pallet load with said stretched film;

(iii) planetary gear including rotatable ring gear means and output means, said output means engageable with said driving means;

(iv) means for rotating said ring gear means and said output means of said planetary gear means;

(v) braking means adapted to bear against said ring gear means in response to variations in said tension when said film is drawn from said roller means so as to vary the relative rotation of said ring gear means and said output means to vary the rate of rotatably driving said roller means in response to variations in said tension and maintain said tension of said film at said preselected level.

22. A method of wrapping pellet loads with a web of material dispensed from a carriage comprising the steps of:

(a) rotating said carriage about said pallet load;

(b) dispensing said web of material from at least one roller means when said web is pulled from said roller means at a preselected tension during rotation of said carriage about said pallet so as to wrap said web about said pallet load;

(c) varying the rate of rotatably driving said roller means by planetary gear means having rotatable ring gear means and output means by variably braking said ring gear means in response to variations in said tension of said web during rotation of said carriage about said pallet load so as to vary the relative rotation of said ring gear means and said output means to vary the rate of rotatably driving said first and second roller means in response to variations in said tension and maintain said tension of said web drawn from said roller means at said preselected level.

23. A method of wrapping a pallet load with a film of stretchable material and dispensed from a carriage comprising the steps of:

(a) rotating said carriage about said pallet load;

(b) stretching said stretchable material a predetermined amount between said first and second roller means when said stretch material is pulled from said roller means at a preselected tension during rotation of said carriage about said pallets so as to wrap said stretched film about said pallet film;

(c) varying the rate of rotatably driving said roller means by planetary gear means having rotatable ring gear means and output means by variably breaking said ring gear means in response to variations in said tension of said stretch material during rotation of said carriage about said pallet load so as to vary the relative rotation of said ring gear means and said output means to vary the rate of rotatably driving said first and second roller means in response to variations in said tension and maintain said tension of said stretched material drawn from said roller means at said preselected level.

24. A method as claimed in claim 23 including the steps of sensing said tension of said stretch material drawn from said roller means.

25. A method as claimed in claim 24 including the steps of activating said planetary gear means in response to sense variations of said stretch material drawn from said roller means so as to maintain said tension at said preselected level.

26. A carriage for rotational movement about a pallet load for dispensing a web of stretchable film about a pallet load comprising:

(a) first and second roller means for stretching said material a predetermined about during rotation of said carriage about said pallet so as to wrap said film about said pallet load;

(b) first and second sprocket means associated with said first and second roller means;

(c) endless chain means engageable with said first and second sprocket means for rotating said first and second roller means whereby said second roller means is rotated at a higher rate than said first roller means so as to stretch said film a predetermined amount between said first and second roller means when said stretchable film is dispensed from said first and second roller means at a preselected tension during rotation of said carriage about said pallet load so as to wrap said film about said load;

(d) planetary gear means engageable with said endless chain;

(e) motor means engageable with said planetary gear means;

(f) said planetary gear means including:

(i) a ring gear;

(ii) spaced first and second disc means concentrically disposed interiorally of said ring gear wherein one of said disc means includes an aperture and said other disc means includes a driving sprocket fixedly secured to said other disc so as to drive said endless chain;

(iii) a plurality of planetary gears symmetrically disposed between said disc means and rotatably engageable with said ring gear;

(iv) a sun gear rotatably driven by said motor means and adapted to be received by said aperture means of said disc means and rotatably engageable with said planetary gears so as to variably rotatably drive said ring gear and said drive sprocket fixedly secured to said disc in response to variations in said tension of said stretched film, whereby said planetary gears rotatably drive only said ring gear when said tension in said stretched material is less than said preselected level;

(g) brake means for varying the rotation of said ring gear and said drive sprocket in response to variations in said tension of said stretched film.

27. A carriage as claimed in claim 26 wherein said brake means is adapted to variably frictionally engage said ring gear means and variably slow rotation of said ring gear when said tension in said stretchable material variably exceeds said preselected level so as to variably increase the rotation of said drive sprocket, said endless chain, and said first and second sprockets, to rotatably increase the rotation of said first and second roller means so as to increase the speed of dispensing said film stretched at said preselected level and thereby maintain said tension of said stretched film at said preselected level.

28. A carriage as claimed in claim 27 including tension selecting means associated with said brake means and adapted to sense the tension of said prestretched film and variably activate said brake means in response to variations in the tension of said stretched film.

29. A carriage as claimed in claim 25 wherein said first and second roller means include first and second electromagnetic clutch means respectively for engaging and disengaging said roller means from said sprocket means.

30. A carriage as claimed in claim 29 wherein said carriage is adapted to rotate about said pallet load about a vertical axis.

31. A carriage as claimed in claim 30 wherein said carriage is adapted to rotate about said pallet load about a horizontal axis.

* * * * *